US005606779A

United States Patent [19]

Lu

[11] Patent Number: 5,606,779

[45] Date of Patent: Mar. 4, 1997

[54] MICROSCOPICALLY ADJUSTABLE BUCKLE FOR SHOES

[75] Inventor: Jinny Lu, Taichung, Taiwan

[73] Assignee: Monotype Supply Co., Ltd., Taichung, Taiwan

[21] Appl. No.: 654,096

[22] Filed: May 28, 1996

[51] Int. Cl.[6] ..... A43C 11/14

[52] U.S. Cl. ..... 24/68 SK

[58] Field of Search ..... 24/68 SK, 68 R, 24/69 SK, 70 SK, 71 SK; 36/50.1, 50.5

[56] References Cited

U.S. PATENT DOCUMENTS

| | | | |
|---|---|---|---|
| 4,761,898 | 8/1988 | Courvoisier et al. | 24/68 SK X |
| 4,796,337 | 1/1989 | Marxer | 24/68 SK |
| 5,172,454 | 12/1992 | Martignago | 24/68 SK |

FOREIGN PATENT DOCUMENTS

| | | | |
|---|---|---|---|
| 220784 | 5/1987 | European Pat. Off. | 24/68 SK |

*Primary Examiner*—James R. Brittain

[57] ABSTRACT

A buckle device for shoes includes a base member secured on a first upper side portion of a shoe upper, a detent device pivotally and resiliently mounted on the base member having at least a pawl formed on a bottom portion of the detent device for locking a ratchet toothed strap secured to a second upper side portion of the shoe upper with the strap insertable through the base member, and an adjusting device resiliently secured on at least a cantilever mounted on the base member to be normally separable from the ratchet toothed strap for a fastening of the strap on the base member as locked by the detent device, and the adjusting device operatively driving the ratchet toothed strap step by step for microscopically adjusting the tightness of the strap and the shoe to be worn by a user.

6 Claims, 4 Drawing Sheets

MICROSCOPICALLY ADJUSTABLE BUCKLE FOR SHOES

BACKGROUND OF THE INVENTION

U.S. Pat. No. 5,357,690 entitled "Centrally Fastened Shoe Buckle" disclosed a shoe buckle especially for use on a roller skate boot, including a buckle body positioned on a central tongue of a shoe, two straps respectively secured to two upper side portions of a shoe upper and protruding inwardly to the buckle body of the shoe, a reel pivotally secured in the buckle body engageable with the two straps for fastening the two straps, a fastening device for driving the reel for fastening the straps for wearing the shoe, and a releasing device for releasing the two straps for removing the shoe.

However, such a conventional shoe buckle may have the following drawbacks:

1. The buckle body should be positioned on the central tongue, thereby limiting its uses in diversified design styles of shoes or boots.

2. There are many elements or parts forming the shoe buckle, increasing assembly complexity maintenance problems and production cost.

3. The driving of the reel is operated by the driving disk 33, which is not long enough and would require large driving force and cause inconvenience for fastening the straps of the shoe buckle.

The present inventor has found the drawbacks of the conventional shoe buckle and invented the microscopically adjustable buckle means for shoes.

SUMMARY OF THE INVENTION

The object of the present invention is to provide a buckle device for shoes including a base member secured on a first upper side portion of a shoe upper, a detent device pivotally and resiliently mounted on the base member having at least a pawl formed on a bottom portion of the detent device for locking a ratchet toothed strap secured to a second upper side portion of the shoe upper with the strap insertable through the base member, and an adjusting device resiliently secured on at least a cantilever mounted on the base member to be normally separable from the ratchet toothed strap for a fastening of the strap on the base member as locked by the detent device, and the adjusting device operatively driving the ratchet toothed strap step by step for microscopically adjusting the tightness of the strap and the shoe to be worn by a user.

DETAILED DESCRIPTION

Figure 1:
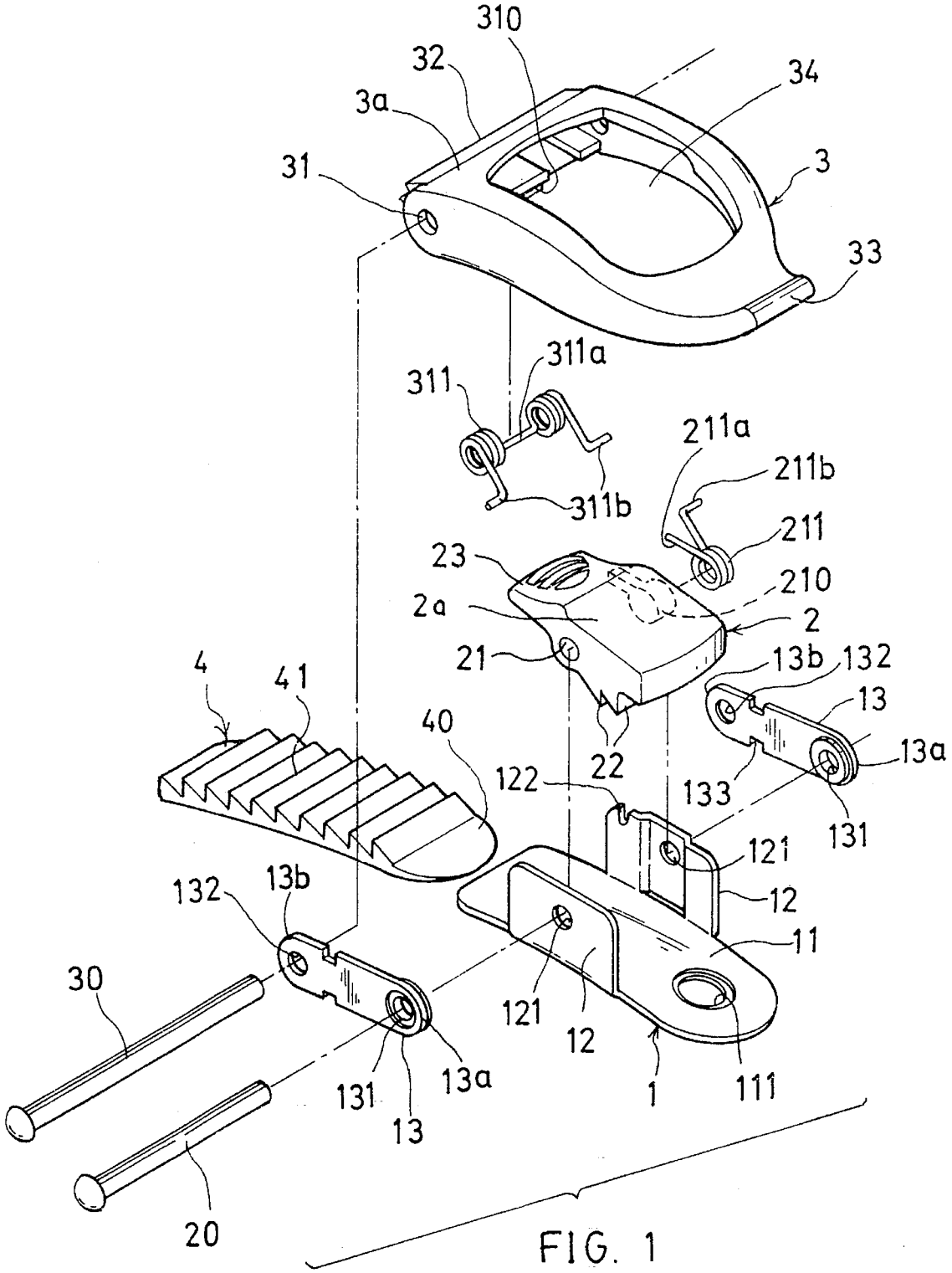
FIG. 1 is an exploded view showing the elements of the present invention.
Figure 2:
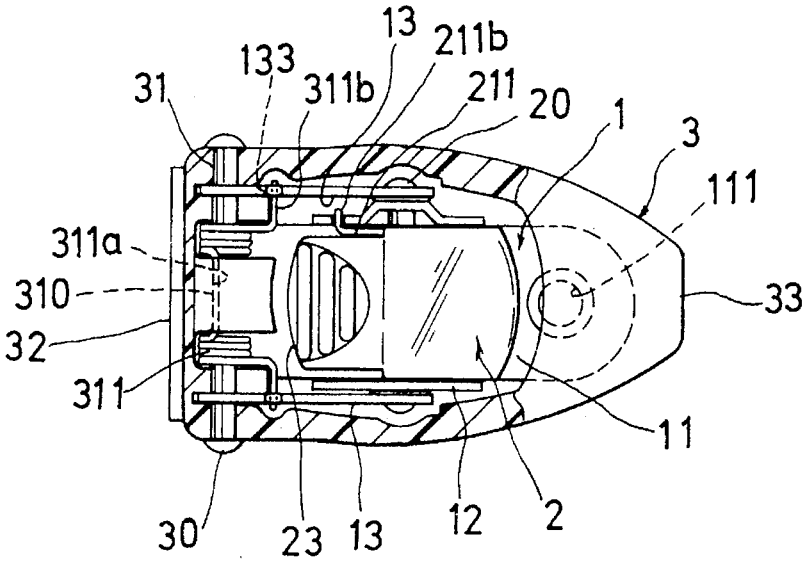
FIG. 2 is a partially cut-away illustration of the present invention from a top view thereof.
Figure 3:
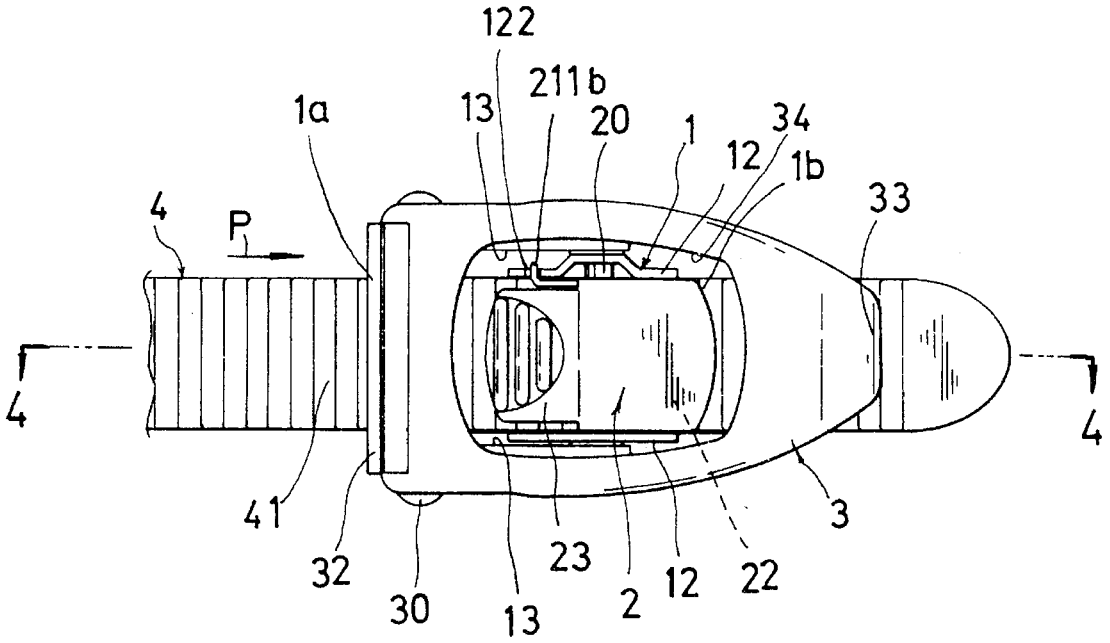
FIG. 3 is a top-view illustration of the present invention.

As shown in the drawing figures, a preferred embodiment of the buckle means of the present invention comprises: a base member 1 secured on a first upper side portion U1 of a shoe especially a roller skate shoe or boot S, a detent means 2 resiliently pivotally secured on the base member 1, an adjusting means 3 pivotally mounted on the base member 1, and a strap 4 secured on a second upper side portion U2 of the shoe S and insertable in between the detent means 2 and the base member 1 to be locked on the base member 1 by the detent means 2, with the adjusting means 3 operatively adjusting the tightness of the strap 4 fastened in between the detent means 2 and the base member 1.

The base member 1 includes: a base plate 11 having at least a fixing hole 111 formed in the base plate 11 to be inserted with a bolt through the fixing hole 111 for fixing the base plate 11 on the first upper side portion U1 of the shoe S, a pair of brackets 12 disposed on two opposite side portions of the base plate 11 each bracket 12 formed with a pivot hole 121 therein, and a pair of cantilevers 13 secured on the pair of brackets 12 by a pivot 20.

Each cantilever 13 is formed with a pivot hole 131 in a proximal end 13*a* of the cantilever 13 for passing the pivot 20 for pivotally mounting the detent and formed with a shaft hole 132 in a distal end 13*b* of the cantilever 13 for passing a shaft 30 for pivotally securing the adjusting means 3.

The detent means 2 includes: a clasp member 2*a* having a pivot hole 21 transversely formed in the clasp member 2*a* for passing the pivot 20 through the pivot hole 21, a restoring spring 211 stored in a spring socket 210 recessed in the member 2*a* and having a first spring end 211*a* retained in the spring socket 210 and having a second spring end 211*b* retained in a notch 122 recessed in a bracket 12 on the base plate 11 for normally biasing the clasp member 2*a* to allow at least a pawl 22 formed on a bottom portion of the clasp 2*a* disposed at a first side of the pivot hole 21, and a depression portion 23 formed on the seesaw member 2*a* and disposed at a second side of the pivot hole 21, with the pawl 22 slidably disengaging a ratchet toothed strap 4 secured on the second upper side portion U2 of the shoes S for forwardly (P) free inserting the strap 4 in between the detent means 2 and the base member 1 to pass a plurality of ratchet teeth 41 continuously juxtapositionally formed on the strap 4 from the pawl 22 when pulling a free end portion 40 of the strap 4 from the second upper side portion U2 towards the first upper side portion U1 in order for fastening the strap 4 and the shoes S to be worn by a user's foot (not shown); and upon stopping of the pulling of strap 4, the member 2*a* will be resiliently biased downwardly to allow the pawl 22 to lock the strap 4.

Figure 4:
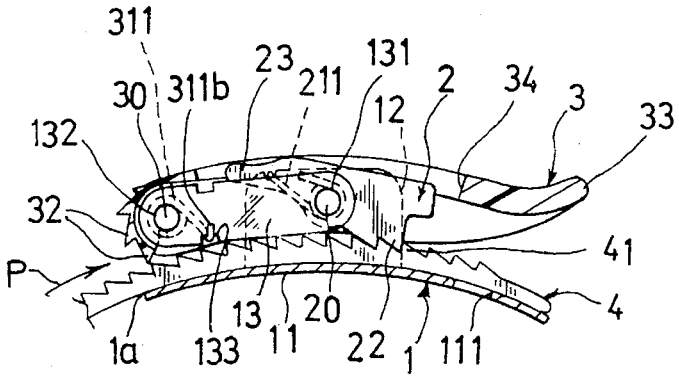
FIG. 4 is a sectional drawing of the present invention when viewed from 4—4 direction of FIG. 3.

Upon stopping of the pulling action (P) of the strap 4 from an inlet port 1*a* between the detent means 2 and the base member 1 towards an outlet port 1*b* between the detent means 2 and the base member 1, the detent means 2 will be resiliently biased as shown in FIG. 4 by downwardly engaging the pawl 22 with a corresponding ratchet tooth 41 formed on the strap 4 for locking the strap 4 on the base member 1 for preventing an unexpected releasing of the strap 4 from the buckle means of the present invention.

Figure 5:
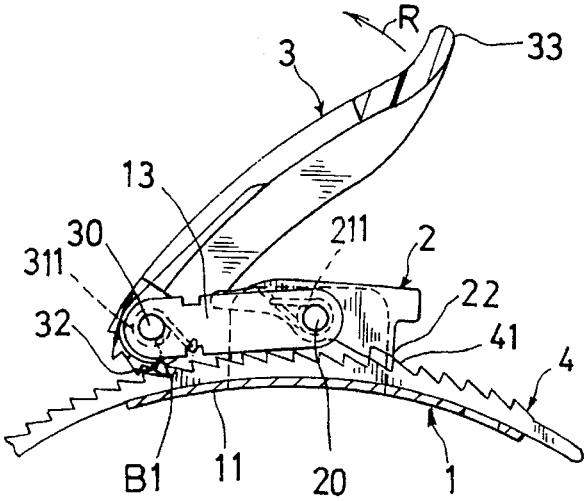
FIG. 5 is an illustration showing a microscopic adjustment of the present invention.

The adjusting means 3 includes: a shaft 30 passing through a shaft hole 31 transversely formed in a driving head portion 3*a* of the adjusting means 3 and passing through a pair of shaft holes 132 formed in the pair of cantilevers 13 with the driving head portion 3*a* pivotally secured on said cantilever 13 by said shaft 30, a ratchet gear portion 32 formed on the driving head portion 3*a* to be engageable with the ratchet teeth 41 formed on the strap 4, and a lever 33 protruding outwardly from the driving head portion 3*a* to serve as a handle for biasing the driving head portion 3*a* and the ratchet gear portion 32 to be engaged with the ratchet teeth 41 on the strap 4 as shown in FIG. 5 (direction R) for forwardly driving the strap 4 in between the detent means 2 and the base member 1 for fastening the strap 4 and the shoe S for wearing a user's foot (not shown).

The lever 33 is reciprocatively biased to forward the strap 4 step by step for "microscopically" adjusting the tightness of the strap 4 and the shoe S for a comfortable wearing thereof.

Figure 6:
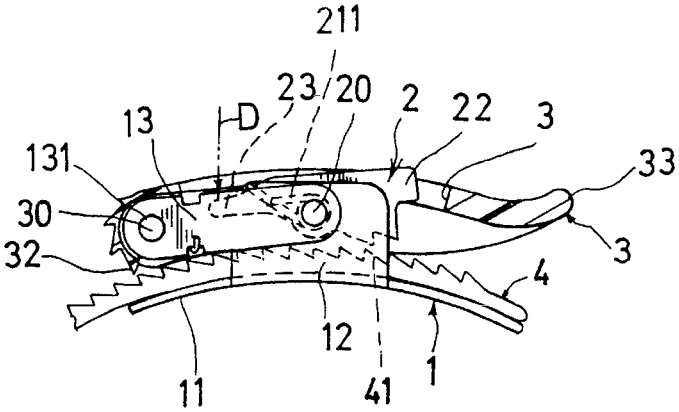
FIG. 6 is an illustration showing the disengagement of the detent means from the ratchet toothed strap in accordance with the present invention.
Figure 7:
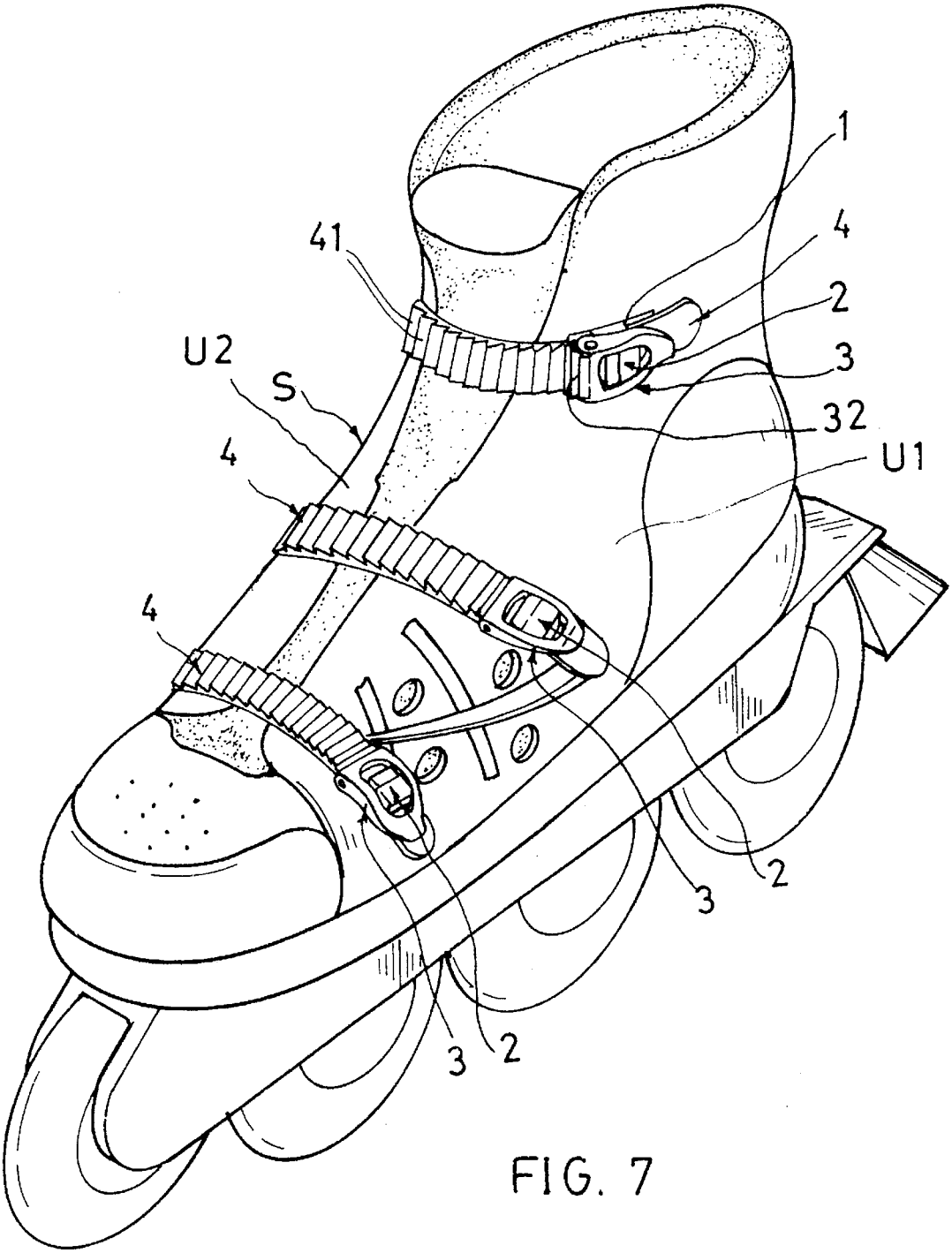
FIG. 7 is a perspective view of the present invention when used on a roller skate shoe.

The adjusting means 3 may be formed with a central opening 34 between the lever 33 and the driving head portion 3*a* for depressing (D) the depression portion 23 of the clasp member 2*a* of the detent means 2 as shown in FIG. 6 (dotted line) for disengaging the pawl 22 from the ratchet tooth 41 of the strap 4 when loosening the strap 4 for removing the shoe S from a wearer thereof.

The adjusting means 3 includes a restoring spring 311 having a first spring end 311*a* retained in a spring holding portion 310 formed in the driving head portion 3*a* of the adjusting means 3, and having a second spring end 311*b* retained in a notch 133 recessed in the cantilever 13 for normally urging the driving head portion 3*a* of the adjusting means 3 upwardly as shown in FIG. 4 to allow a normal forward insertion (P) of the strap 4 in between the detent means 2 and the base member 1.

The present invention is superior to the conventional shoe buckles with the following advantages:

1. An adjusting means 3 is provided for a step-by-step adjustment of the tightness of the strap 4 and the shoe S when worn by a user's foot.

2. The ratchet toothed strap 4 engageable with the pawl 22 of the detent means 2 may serve as a "brake" for occasionally locking the strap 4 on the base member 1 when manually pulling the free end 40 of the strap 4 for initially fastening the strap 4 on the base member 1 for a quicker fastening of the buckle means. Then, the adjusting means 3 may be further manipulated for a "microscopic" adjustment for the tightness of the strap 4 and the buckle means of the present invention, thereby providing an instant, efficient and reliable fastening of the strap when wearing a shoe.

3. The elements and mechanism for locking and unlocking the strap 4 have been simplified for reducing production cost and decreasing operation and maintenance thereof.

4. The buckle means may be mounted on a side portion of a shoe upper, not being limited to be positioned at a central tongue of the shoe, thereby being suitable for diversified design styles of modern shoes or boots.

The present invention may be provided on a roller skate shoe or boot, or may be used on other sporting footwears or shoes.

The present invention may be modified without departing from the spirit and scope as claimed hereinafter.

I claim:

1. A buckle means for use on a shoe comprising:

a base member secured on a first upper portion of a shoe;

a strap having a plurality of ratchet teeth formed thereon and secured on a second upper portion of the shoe;

a detent means pivotally resiliently mounted on said base member for locking the strap when inserted in between the base member and the detent means for fastening the strap therebetween; and an adjusting means pivotally secured on said base member, and normally separable from said strap, and operatively engageable with said strap for forwardly driving said strap in between said detent means and said base member for adjusting a tightness of said strap on said base member as locked by said detent means.

2. A buckle means according to claim 1, wherein said base member includes: a base plate secured on a first upper side portion of a shoe for resting said strap thereon, a pair of brackets disposed on two opposite side portions of the base plate each said bracket formed with a pivot hole therein, and a pair of cantilevers secured on the pair of brackets by a pivot passing through the pivot hole in the bracket;

each said cantilever formed with a pivot hole in a proximal end of the cantilever for passing a pivot for pivotally mounting the detent means and formed with a first shaft hole in a distal end of each said cantilever for passing a shaft through said first shaft hole for pivotally securing the adjusting means.

3. A buckle means according to claim 2, wherein said detent means includes: a clasp member pivotally mounted on said pair of brackets on said base member, a restoring spring stored in a spring socket recessed in the clasp member and having a first spring end retained in the spring socket and having a second spring end retained in a notch recessed in one said bracket on the base plate for normally biasing the clasp member to allow at least a pawl formed on a bottom portion of the clasp member disposed at a first side of the clasp member, and a depression portion formed on the clasp member and disposed at a second side of the clasp member, with the pawl normally engageable with said strap formed with a plurality of ratchet teeth thereon and secured on the second upper side portion of the shoe for locking the strap on said base member, whereby upon disengagement of said detent means from said base member, said strap is forwardly inserted in or released from between said detent means and said base member.

4. A buckle means according to claim 2, wherein said adjusting means includes: said shaft passing through a second shaft hole transversely formed in a driving head portion of the adjusting means and passing through a pair of said first shaft holes formed in the pair of cantilevers with the driving head portion pivotally secured on said cantilever by said shaft, a ratchet gear portion formed on the driving head portion to be engageable with a plurality of ratchet teeth formed on the strap, and a lever protruding outwardly from the driving head portion to be a handle for biasing the driving head portion and the ratchet gear portion to be engaged with the ratchet teeth on the strap for forwardly driving the strap in between the detent means and the base member for fastening the strap and the shoe for wearing on a user's foot.

5. A buckle means according to claim 4, wherein said adjusting means is formed with a central opening between the lever and the driving head portion for depressing a depression portion of a clasp member of the detent means for disengaging the detent means from the strap when loosening the strap for removing the shoe from a wearer.

6. A buckle means according to claim 4, wherein said adjusting means includes a restoring spring having a first spring end retained in a spring holding portion formed in the driving head portion of the adjusting means, and having a second spring end retained in a notch recessed in the cantilever for normally urging the driving head portion of the adjusting means upwardly to allow a normal forward insertion of the strap in between the detent means and the base member.

* * * * *